United States Patent [19]

Schreiner

[11] 4,377,241

[45] Mar. 22, 1983

[54] PALLET FRAME

[75] Inventor: Charles P. Schreiner, Saugatuck, Mich.

[73] Assignee: Westinghouse Electric Corp., Pittsburgh, Pa.

[21] Appl. No.: 212,953

[22] Filed: Dec. 4, 1980

[51] Int. Cl.[3] ..... B01D 27/10

[52] U.S. Cl. ..... 211/133; 108/55.1; 108/51.1; 211/126

[58] Field of Search ..... 211/133, 126, 194; 108/55.1, 53.1, 53.3, 53.5

[56] References Cited

U.S. PATENT DOCUMENTS

| | | | |
|---|---|---|---|
| 2,666,552 | 1/1954 | Coit, Jr. | 108/55.1 X |
| 3,177,823 | 4/1965 | Entel | 108/53.5 |
| 3,258,128 | 6/1966 | McPherson | 211/133 |
| 3,531,855 | 10/1970 | Spring, Jr. | 108/51.1 X |
| 3,795,206 | 3/1974 | Utz | 108/51.1 |
| 3,857,494 | 12/1974 | Giardini | 108/55.1 X |
| 4,228,906 | 10/1980 | Jones | 211/126 |
| 4,274,687 | 6/1981 | Bayles | 211/126 X |

FOREIGN PATENT DOCUMENTS

| | | | |
|---|---|---|---|
| 1000346 | 1/1957 | Fed. Rep. of Germany | 211/126 |

*Primary Examiner*—Francis K. Zugel
*Assistant Examiner*—Peter A. Aschenbrenne
*Attorney, Agent, or Firm*—B. R. Studebaker

[57] ABSTRACT

A pallet frame for storing and transporting a plurality of material handling totes. The pallet frame includes a plurality of pairs of back-to-back spaced vertically aligned support rails carried centrally on a frame which provides for forklift transfer and stackability. Support rails are constructed and arranged to hold a plurality of variably sized material handling totes cantilevered from the support rails.

11 Claims, 7 Drawing Figures

PALLET FRAME

BACKGROUND OF THE INVENTION

In modern manufacturing processes, particularly those employed in the electronics industry, there is a need for a facility to handle large numbers of comparatively small electronic parts, such as printed circuit boards and the like. During these manufacturing processes there is a need to store parts and subassemblies at various stages of the process. For example, the parts and subassemblies need to be stored in large storage areas in large numbers and to have the ability to be moved in large quantities by industrial fork trucks and the like. These parts in smaller numbers also need to be moved from storage areas to work areas by hand carts and the like and to be stored at work areas under work surfaces or on vertical wall surfaces for access by manufacturing personnel.

A system has been developed which employs a uniquely designed material handling tote of the type disclosed in U.S. patent application Ser. No. 212,946 filed the same day as this application for MATERIAL HANDLING TOTE by Charles P. Schreiner et al. The material handling tote may be employed in a total material handling system and may be for example stored in large numbers on the pellet frame which forms the subject matter of this application. The material handling tote may also be moved from place to place and stored on a push cart of the type disclosed in copending application Ser. No. 212,954, filed the same date as this application by Charles P. Schreiner for a MATERIAL HANDLING CART. Additionally, these material handling totes may be supported by a wall hung support rail of the type disclosed in copending application Ser. No. 212,944 filed by Charles P. Schreiner the same day as this application for a WALL-HUNG SUPPORT RAIL or stored beneath a work surface on pairs of tote guides, the type disclosed in copending application Ser. No. 212,945 filed the same date as this application by Charles P. Schreiner for TOTE GUIDE now issued as U.S. Pat. No. 4,334,715. Each of the foregoing applications are owned by the same assignee as this application.

SUMMARY OF THE INVENTION

The pallet frame of this invention for transporting a plurality of material handling totes includes a base frame and a pair of upright end frames. The base frame includes an elongated central base member and a corner block at each corner of the base frame with the central base member and corner blocks extending below the remainder of the base frame to define forklift receiving channels. A plurality of horizontally disposed vertically spaced pairs of support rails extend parallel with the central base member and are supported at each end by the end frames and are adapted to receive material handling totes thereon. The end frames, in addition to a central load bearing member, include corner posts at each end thereof which are situated outwardly of the corners of the bottom frame but connected thereto. These corner posts are cylindrical and include an inverted cup-shaped member on the bottom ends thereof whereby a plurality of pallet frames are stackable, one upon another, when the cup-shaped members of one pellet frame are positioned on the top of the corner posts of another pellet frame. Each of the plurality of support rails are spaced, vertically aligned, pairs of support rails with the support rails of each pair arranged back-to-back and spaced one from the other by a spacer block which interconnects the support rails of each pair approximate their midpoint. Each of the support rails are tubular and include a flat back portion and a front portion that is parallel with the back portion for its lower half and tapered toward the back portion for its upper half to thereby accommodate material handling totes of the type disclosed in the aforesaid copending application Ser. No. 212,946.

BRIEF DESCRIPTION OF THE DRAWINGS

Many of the attendant advantages of the present invention will become more readily apparent and better understood as the following detailed description is considered in connection with the accompanying drawings in which.

DESCRIPTION OF THE PREFERRED EMBODIMENT

Figure 1:
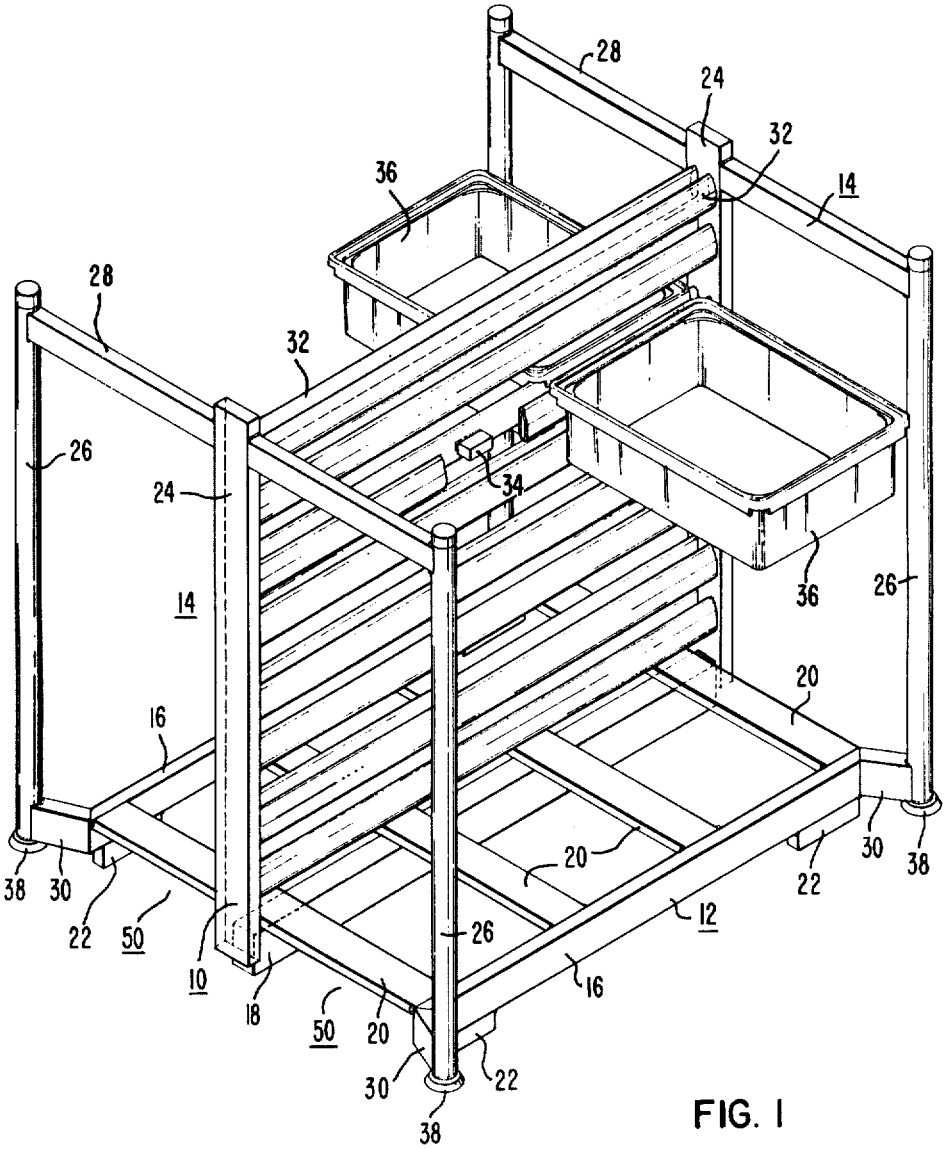
FIG. 1 is an isometric illustration of the pallet frame of this invention with material handling totes mounted thereon.
Figure 2:
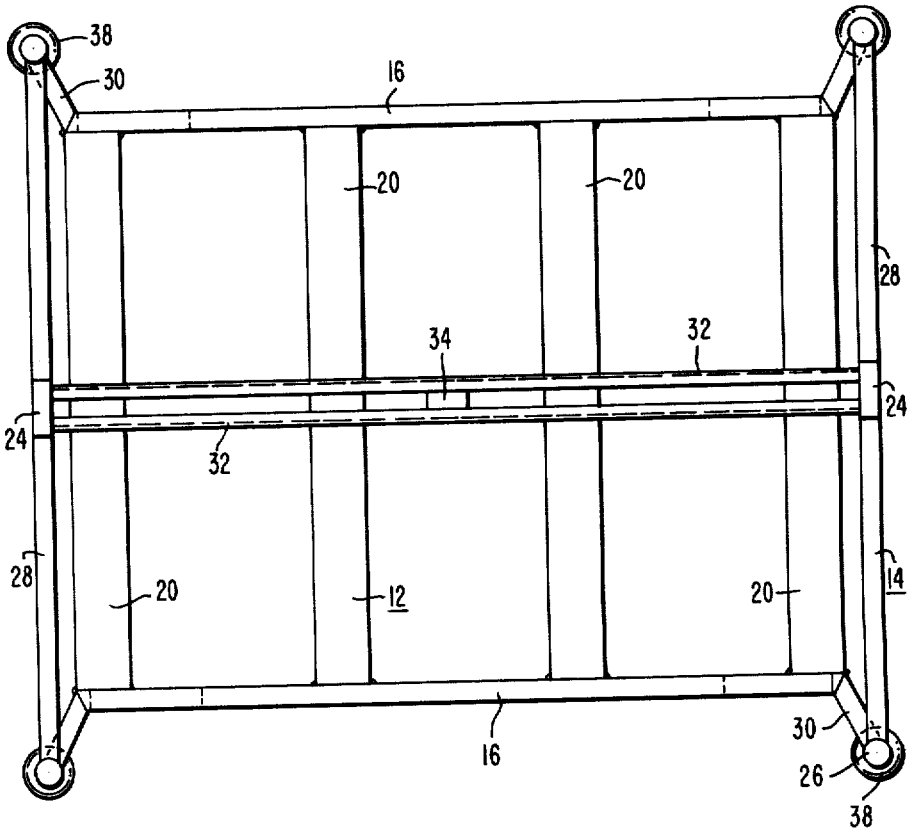
FIG. 2 is a top plan view of the pallet frame of this invention.
Figure 3:
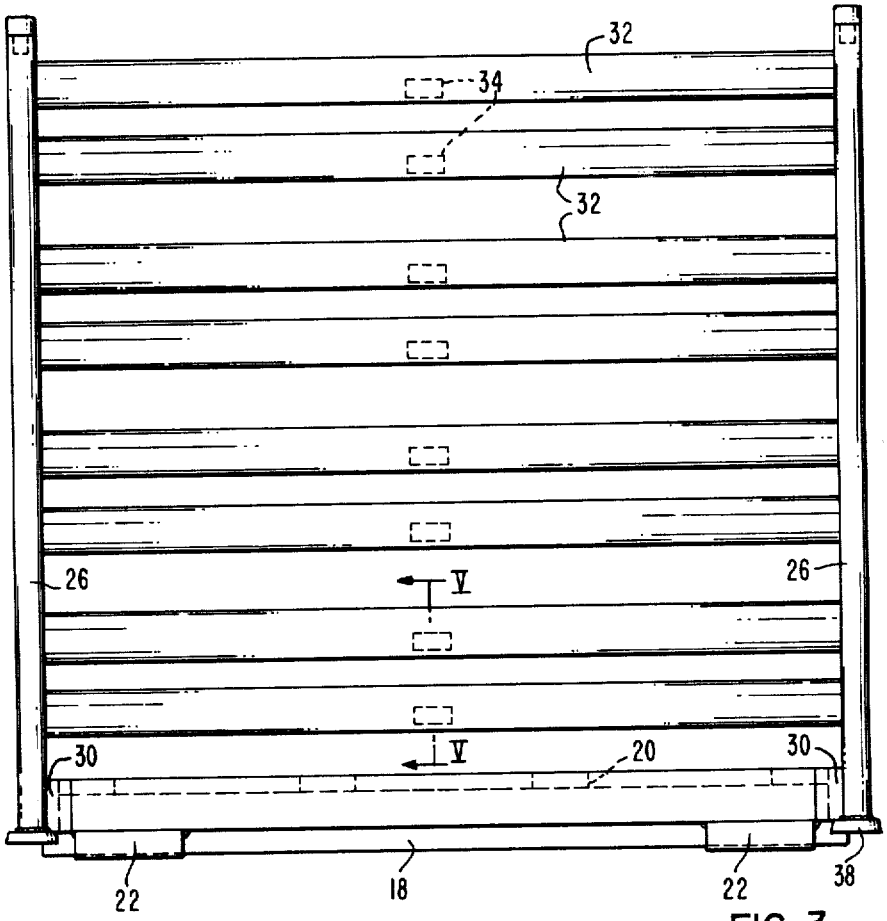
FIG. 3 is a side elevation view thereof.
Figure 4:
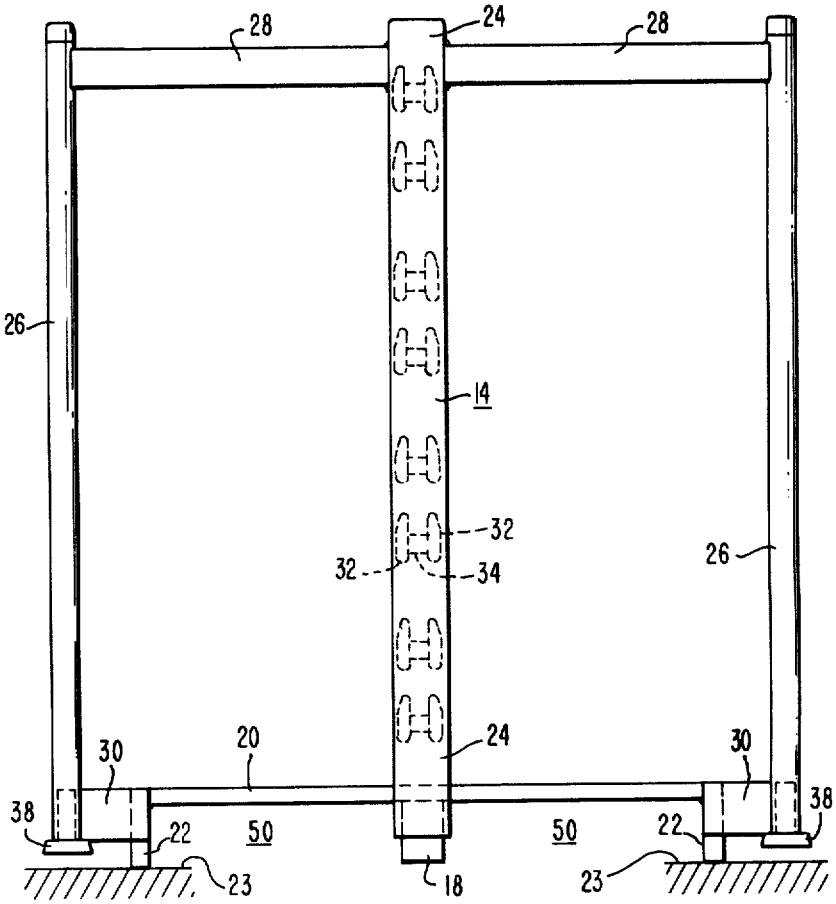
FIG. 4 is an end elevation view thereof.

Referring now in detail to the drawing wherein like reference characters represent like parts throughout the several views, there is illustrated in FIG. 1, the pallet frame generally designated 10 of this invention. The pallet frame 10 of this invention includes a bottom or base frame 12 and a pair of end frames 14. The base frame 12 includes a pair of parallel side rails 16 and a center beam 18 which are interconnected by a plurality of slat members 20. On the underside at each corner of the base frame are corner or base blocks 22 upon which the pallet frame rests on a flat surface such as a floor 23 or the like (FIG. 4).

The end frames 14 include a central upright post member or load bearing member 24 and corner post members 26 which are cylindrical and are connected to the central load bearing member 24 at their upper ends by horizontal slats 28 and connected adjacent their bottom end to the side rails 16 of the bottom frame 12 by angularly positioned post connecting members 30. The post connecting members 30 extend outwardly from and at an angle with respect to the corners of the base or bottom frame 12.

The central load bearing upright support members 24 of each end frame 14 are interconnected by a plurality of vertically aligned spaced parallel support rails 32. The support rails 32 are mounted in parallel pairs of support rails and the rails 32 in each pair are interconnected adjacent their midpoint by a spacer block 34. Each pair of back-to-back support rails 32 interconnect the upright load bearing members 24 in a predetermined spaced relationship with respect to the next lower or next above pair of support rails in order to accommodate material handling totes 36 of the type disclosed in copending application Ser. No. 212,946, filed the same day as this application by Charles P. Schreiner et al., and owned by the assignee of this invention, in a cantilevered fashion as illustrated in FIG. 1. As will be apparent the parallel pairs of spaced support rails are spaced a sufficient distance one from the other in each pair of accommodate material handling totes on either side of the pallet frame.

At the bottom of each of the corner posts 26 there is provided an inverted cup-shaped member 38 which provides stackability to the pallet frame of this invention. The angular post connecting members 30 which interconnect the bottom ends of the corner post members 26 to the bottom frame 12 cause the cup-shaped members 38 to be positioned above the plane of the undersides of the corner blocks 22 and hence above floor level. Also, the connecting members 30 serve to place the post members 30 outside the periphery of the bottom frame 12.

Figure 5:
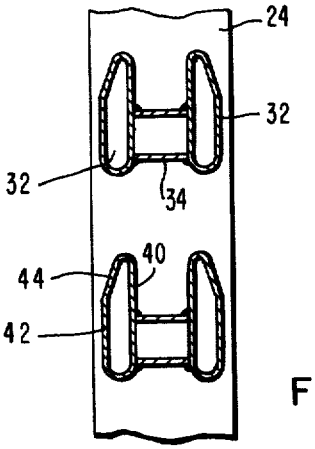
FIG. 5 is a sectional view taken along the line V—V of FIG. 3.

As best illustrated in FIG. 5, the support rails 32 interconnected by the spacer block 34 are preferably of tubular construction and include a flat back wall or portion 40 and a front wall or portion that is essentially parallel with the back wall 40 for its lower half 42 and tapered toward the back portion 40 for its upper half 44. This particular configuration for the support rails 32 provide for ease of mounting of material handling totes 36 to the pallet frame as well as providing a configuration which will allow the material handling totes 36 to remain in an essentially horizontal cantilevered position with respect to the support rails and pallet frame.

All of the elements of the pallet frame of this invention are preferably manufactured from 12 or 14 gauge steel tubing with the exception of the corner blocks 22 and the center beam or base member 18 which are preferably steel bars.

Figure 6:
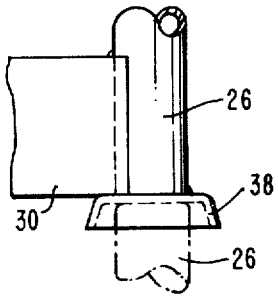
FIG. 6 is an enlarged view of the bottom right hand corner of FIG. 4, illustrating the stackability of the pallet frame of this invention.
Figure 7:
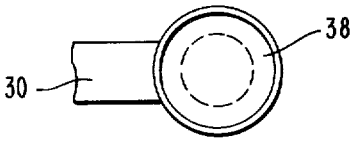
FIG. 7 is a bottom plan view of the portion of the pallet frame illustrated in FIG. 6.

As will be apparent, and can best be seen from FIGS. 1 and 4, the pallet frame of this invention provides for a pair of channels 50 which are adapted to receive the forks of a standard forklift truck to move the pallet frame from place to place. Additionally, as best illustrated in FIG. 6, it will be seen that the cup members 38 at the bottom end of the corner posts 26 are constructed and arranged to receive therein the upper end of the corner posts 26 of another pallet frame thereby providing stackability to the pallet frame of this invention.

As will be apparent from the foregoing, the pallet frame of this invention provides a facility for the bulk storage of electronic parts and the like in material handling totes with the mobility of a typical industrial pallet configuration.

What is claimed is:

1. A pallet frame for storing and transporting a plurality of material handling totes, said pallet frame comprising:

a bottom frame defining forklift receiving channels on the underside thereof and including an elongated central base member and base blocks at each corner thereof for supporting said pallet frame on a flat surface;

a pair of end frames mounted to said bottom frame, each of said end frames including a central load bearing member and a corner post at each end thereof, each of said corner posts being outwardly of the corner of said bottom frame and connected thereto; and a plurality of support rails interconnecting said central load bearing members, each of said support rails being constructed and arranged to support a material handling tote.

2. The pallet frame according to claim 1 wherein said corner posts are cylindrical and include an inverted cup-shaped member at the bottom end thereof whereby a plurality of said pallet frames are stackable one upon another when the cup-shaped members of one pallet frame are positioned on the tops of the corner posts of another pallet frame.

3. The pallet frame according to claim 1 wherein said plurality of support rails are a plurality of spaced vertically aligned pairs of support rails.

4. The pallet frame according to claim 3 wherein each of said support rails in each of said pairs of support rails are arranged back-to-back and spaced one from the other and a spacer block interconnects said support rails of said pairs proximate their midpoint.

5. The pallet frame according to claim 1 wherein said support rails are tubular and include a flat back portion and a front portion that is parallel with said back portion for its lower half and tapered toward said back portion for its upper half.

6. A pallet frame for storing and transporting a plurality of material handling totes, said pallet frame comprising:

a base frame and a pair of upright end frames, said base frame including an elongated central base member and a corner block at each corner of said base frame, said central base member and corner blocks extending below the remainder of said base member to define forklift receiving channels in the underside of said pallet frame;

a plurality of horizontally disposed vertically spaced pairs of support rails extending parallel with said central base member and supported at each end by said end frames, said support rails adapted to receive material handling totes thereon.

7. A pallet frame according to claim 6 wherein said end frames include cylindrical corner posts having inverted cup-shaped members at the bottom ends thereof whereby a plurality of said pallet frames are stackable one upon another when the cup members of one pallet frame are positioned on the tops of the cylindrical corner posts of another pallet frame.

8. A pallet frame according to claim 6 wherein each of said support rails in each of said pairs of support rails are arranged back-to-back and spaced one from the other and a spacer block interconnects said support rails of said pairs proximate their midpoint.

9. A pallet frame according to claim 6 wherein said support rails are tubular and include a flat back portion and a front portion that is parallel with said back portion for its lower portion and tapered toward said back portion for its upper portion.

10. A pallet frame according to claim 6 wherein each of said end frames include a central load bearing member and a pair of corner posts, a slat member interconnects each of said central load bearing members to said corner posts adjacent their upper ends and post connecting members interconnect the bottoms of said corner posts and the corners of said base frame, said post connecting members being directed outwardly off and at an angle with respect to the corners of said base frame.

11. A pallet frame according to claim 10 wherein said support rails are supported by said central load bearing members of said end frames.

* * * * *